US011215086B2

(12) United States Patent
Monsarrat et al.

(10) Patent No.: US 11,215,086 B2
(45) Date of Patent: Jan. 4, 2022

(54) TURBOMACHINE ROTOR ROTATING SYSTEM AND TURBOMACHINE ROTOR

(71) Applicant: SAFRAN AIRCRAFT ENGINES, Paris (FR)

(72) Inventors: Eric Monsarrat, Moissy Cramayel (FR); Ludovic Benoit, Moissy Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 14 days.

(21) Appl. No.: 16/623,636

(22) PCT Filed: Jun. 19, 2018

(86) PCT No.: PCT/FR2018/051463
§ 371 (c)(1),
(2) Date: Dec. 17, 2019

(87) PCT Pub. No.: WO2018/234681
PCT Pub. Date: Dec. 27, 2018

(65) Prior Publication Data

US 2020/0191019 A1 Jun. 18, 2020

(30) Foreign Application Priority Data

Jun. 20, 2017 (FR) ..... 1755598

(51) Int. Cl.
*F01D 25/36* (2006.01)
*F04D 29/32* (2006.01)
*F04D 29/64* (2006.01)

(52) U.S. Cl.
CPC ..... *F01D 25/36* (2013.01); *F04D 29/321* (2013.01); *F04D 29/644* (2013.01); *F05D 2220/36* (2013.01)

(58) Field of Classification Search
CPC ..... F01D 25/34; F01D 25/36; F01D 25/285; F01D 21/003; F05D 2220/36;
(Continued)

(56) References Cited

U.S. PATENT DOCUMENTS 4,446,728 A * 5/1984 Ito ..... F01D 25/34 73/112.01
4,446,766 A * 5/1984 Lucey ..... F01D 25/34 74/96

(Continued)

FOREIGN PATENT DOCUMENTS

DE 21 14 916 B1 5/1972
EP 0 042 670 A1 12/1981

(Continued)

OTHER PUBLICATIONS

International Search Report as issued in International Patent Application No. PCT/FR2018/051463, dated Aug. 3, 2018.

*Primary Examiner* — Brian P Wolcott
(74) *Attorney, Agent, or Firm* — Pillsbury Winthrop Shaw Pittman LLP

(57) ABSTRACT

A system for rotating a turbomachine rotor relative to a stator casing, the rotor including an annular row of blades, the rotating system including a supporting arm including a first end arranged for gripping a leading edge of a first blade of the annular row and a second end arranged for gripping a trailing edge of the first blade; an electric motor including a shaft and a body attached to the supporting arm; and a wheel coupled to the shaft of the motor and provided with a rolling strip, the wheel, furthermore, being arranged so that the rolling strip can come into contact with an annular wall of the stator casing when the supporting arm is mounted on the first blade.

15 Claims, 2 Drawing Sheets

(58) Field of Classification Search
CPC ..... F05D 2260/02; F05D 2260/83; G01M 15/02; G01M 15/14
See application file for complete search history.

(56) References Cited

U.S. PATENT DOCUMENTS

| | | | | |
|---|---|---|---|---|
| 7,654,143 | B2 * | 2/2010 | Roney | G01N 29/223 73/620 |
| 8,602,722 | B2 * | 12/2013 | George | G01N 21/954 415/118 |
| 9,683,461 | B2 * | 6/2017 | Staehli | F01D 25/36 |
| 9,816,488 | B2 * | 11/2017 | Rose, Jr. | F03D 80/50 |
| 9,903,434 | B2 * | 2/2018 | Erno | F01D 5/16 |

FOREIGN PATENT DOCUMENTS

| | | | | |
|---|---|---|---|---|
| GB | 2 394 523 A | | 4/2004 | |
| GB | 2394523 A | * | 4/2004 | F16C 1/06 |
| GB | 2536764 A | * | 9/2016 | F01D 21/003 |
| GB | 2581334 A | * | 8/2020 | F01D 25/36 |
| SU | 754 925 A1 | | 1/1984 | |

* cited by examiner

TURBOMACHINE ROTOR ROTATING SYSTEM AND TURBOMACHINE ROTOR

CROSS-REFERENCE TO RELATED APPLICATIONS

This application is the U.S. National Stage of PCT/FR2018/051463, filed Jun. 19, 2018, which in turn claims priority to French patent application number 1755598 filed Jun. 20, 2017. The content of these applications are incorporated herein by reference in their entireties.

TECHNICAL FIELD

The present invention relates generally to the field of turbomachines, such as twin-spool turbofans for aircraft. The invention concerns more specifically a system enabling a turbomachine rotor to be rotated during a quality control of or maintenance operation on the turbomachine.

STATE OF THE PRIOR ART

A twin-spool turbofan generally comprises, from upstream to downstream in the direction in which the gases flow, a fan, a low-pressure compressor, a high-pressure compressor, a combustion chamber, a high-pressure turbine, a low-pressure turbine and a combustion gas exhaust nozzle. The fan, the compressors and the turbines each consist of a first assembly of fixed parts, called the stator, and of a second assembly of parts which can be rotated relative to the stator, called the rotor.

Turbojet rotors comprise in particular one or more disks to the periphery of which blades are attached. They can be coupled by different transmission systems. For example, the rotors of the low-pressure compressor and of the low-pressure turbine form a low-pressure spool and are connected to one another by a low-pressure shaft. Similarly, the high-pressure compressor and the high-pressure turbine form a high-pressure spool and are connected to one another by a high-pressure shaft disposed around the low-pressure shaft. The low-pressure and high-pressure shafts are centered on the turbojet's longitudinal axis and are not linked mechanically. The fan rotor, which is radially surrounded by a fan case, is driven directly or indirectly (by means of a reducing gear) by the low-pressure shaft.

The stator of the compressors and the turbines notably comprises an external annular casing and stationary blade rings, supported by the annular casing. These stator blade rings extend radially towards the interior of the annular casing, and act as flow-rectifiers or gas flow guide vane elements (depending on whether a compressor or a turbine is involved).

The delivery of a turbojet to the aircraft manufacturer is always preceded by a quality control, intended to ensure that the turbojet is compliant. This quality control comprises in particular a step of endoscopy, in order to check for the absence of defects (impacts, cracks, etc.) inside the various compartments of the turbojet. The search for defects by endoscopy is undertaken in particular on the blades, disks and casings of the fan, of the (low-pressure and high-pressure) compressors and of the (low-pressure and high-pressure) turbines.

In order to inspect all the blades of the fan, of a compressor or of a turbine, the corresponding rotor must be rotated. To do so, a drive system for rotating a turbomachine rotor can be used. The current drive system comprises a first portion equipped with a drive motor, which is attached to the end of the fan shaft, and a second portion (a power bar), which is attached to the flanges of the fan casing.

This drive system is however not practical to use, since installing it in the turbojet and removing it from the turbojet are long and complicated operations. In particular, before attaching the first portion at the end of the fan shaft, the nose dome of the turbojet must be disassembled. Handling the system is also particularly difficult since it is heavy and bulky. Handling requires two operators to reduce the occupational risks.

Therefore, the current drive system is very often not used, and the fan rotor is instead rotated manually. This solution also requires two operators, one checking the parts using the endoscope, the other manually rotating the rotor using the blades.

SUMMARY OF THE INVENTION

There is therefore a need for a system for rotating a turbomachine rotor which is compact, rapid and easy to install in the turbomachine, in order that it can be handled without risk by a single person.

According to a first aspect of the invention, this need tends to be satisfied by providing a drive system for rotating a turbomachine rotor relative to a stator casing, the rotor comprising an annular row of blades, the drive system comprising:

- a support arm comprising a first end arranged for gripping a leading edge of a first blade of the annular row and a second end arranged for gripping a trailing edge of the first blade;
- an electric motor comprising a shaft and a body attached to the support arm;
- a wheel coupled to the shaft of the motor and provided with a rolling strip, the wheel is being further arranged such that the rolling strip comes into contact with an annular wall of the stator casing when the support arm is mounted on the first blade.

Thanks to its support arm, the drive system according to the invention can be mounted directly on a blade of the rotor. More specifically, the support arm is disposed at one end of the blade (head or root) in order that the wheel of the system can be supported by an annular (outer or inner) wall of the stator casing and the rotor can be made to rotate. Since the blades of the rotors are of easy access, in particular the blades of the fan rotor, installing the drive system is simple and rapid. In particular, it requires no prior disassembly, such as that of the nose dome. Removing the drive system from the turbomachine is just as easy. In addition, given that the length support arm is of the same order of magnitude as the width of a blade (i.e. the distance separating the leading and trailing edges of the blade), the drive system according to the invention is relatively compact. It can therefore easily be handled by a single person.

In a first embodiment, the drive system comprises at least one battery secured to the support arm and electrically connected to the motor.

In a second embodiment, the drive system further comprises:

- a battery tray configured to be mounted on a second blade of the annular row, diametrically opposite the first blade; and
- at least one battery secured to the battery tray and electrically connected to the electric motor.

According to one development of the second embodiment, the battery tray comprises a first end arranged for gripping a leading edge of the second blade and a second end arranged for gripping a trailing edge of the second blade.

According to another development of the second embodiment:

- the support arm, the electric motor and the wheel belong to a first subassembly of elements intended to be mounted on the first blade;
- the battery tray and the said at least one battery belong to a second subassembly of elements intended to be mounted on the second blade; and
- the first and second subassemblies of elements have substantially identical masses.

The drive system according to the first aspect of the invention can also have one or more of the characteristics below, considered individually or in all technically possible combinations:

- the motor and the wheel are positioned between the first and second ends of the support arm;
- the first end of the support arm comprises a clamp and the second end of the support arm is shaped like a hook;
- the electric motor is of the stepper type;
- the wheel is equipped with a speed reducer; and
- the support arm is made of a polymer material, such as polylactic acid (PLA).

A second aspect of the invention concerns a turbomachine rotor, and more specifically a turbofan fan rotor, equipped with the drive system according to the first aspect of the invention.

BRIEF DESCRIPTION OF THE FIGURES

Other characteristics and advantages of the invention will become clear from the description which is given of it below, by way of example and non-restrictively, with reference to the appended figures, in which.

For greater clarity, identical or similar elements are identified by identical reference signs in all the figures.

DETAILED DESCRIPTION OF AT LEAST ONE EMBODIMENT

In the following description, the terms "upstream" and "downstream" must be considered in relation to a main flow direction of the gases (from upstream to downstream) in the turbomachine. In addition, the (longitudinal) axis of the turbomachine is called the turbomachine's "axis of rotation". The turbomachine's axial direction is the direction of the turbomachine's axis. The turbomachine's radial direction is a direction perpendicular to the turbomachine's axis. Unless otherwise specified, the adjectives and adverbs axial, radial, axially and radially are used with reference to the above-mentioned axial and radial directions. In addition, unless otherwise specified, the terms inner (or internal) and outer (or external) are used with reference to a radial direction, such that the inner portion of an element is closer to the axis of the turbomachine than the outer portion of the same element.

Figure 1:
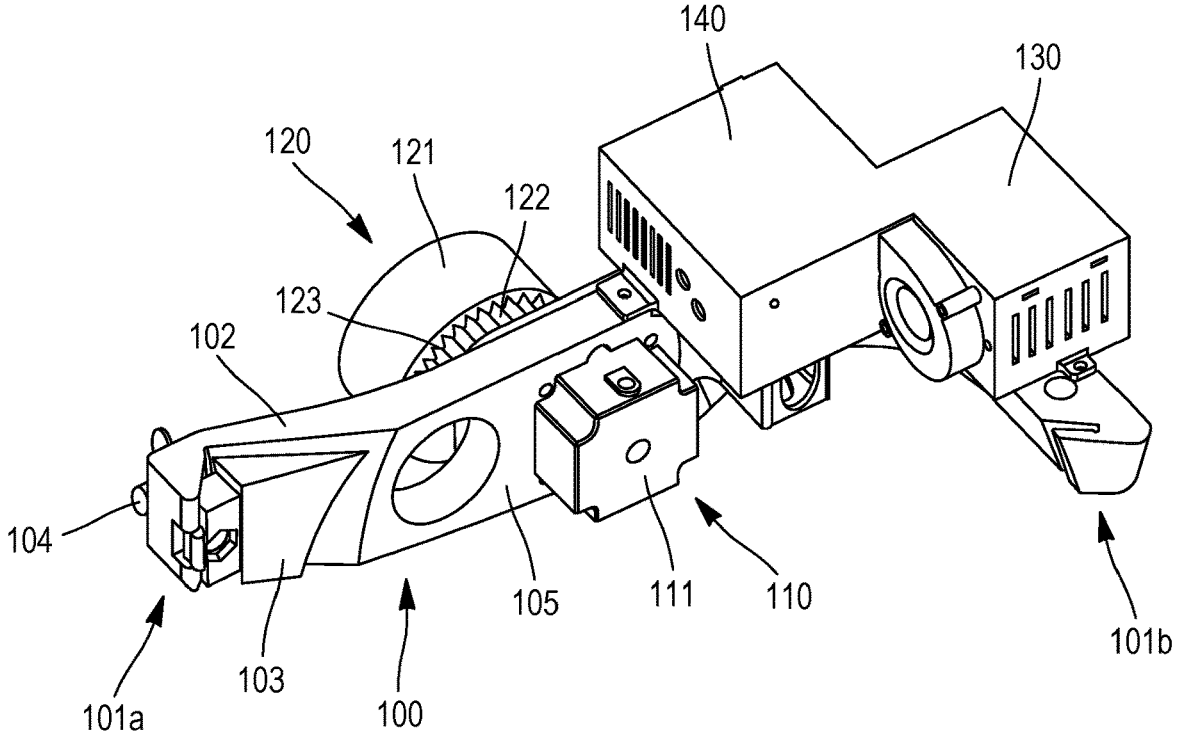
FIG. 1 is a perspective view of a turbomachine rotor drive system according to a first embodiment of the invention.

FIG. 1 illustrates a first embodiment of a system enabling a turbomachine rotor to be rotated, for example during a quality control of, or maintenance operation on, the turbomachine. This drive system is intended for all types of turbomachine, whether terrestrial or aeronautical (turbojet, turboprop, terrestrial gas turbine, etc.), if it comprises at least one rotor provided with an annular row of blades and a stator casing with an annular wall.

In the particular case of a twin-spool turbofan, the drive system can be used to drive the rotor of the fan, the rotor of the low-pressure compressor (or "booster"), the rotor of the high-pressure compressor, the rotor of the low-pressure turbine and/or the rotor of the high-pressure turbine of the turbojet. These various rotors generally rotate around a given axis, which is called the rotational axis, or longitudinal axis, of the turbojet. Furthermore, several rotors can be coupled to one another by transmission systems, in order to be rotated simultaneously. Typically, the rotation of the fan rotor by the drive system is transmitted to the low-pressure compressor, and then to the rotor of the low-pressure turbine.

With reference to FIG. 1, the drive system comprises a support arm 100 of general elongated shape, an electric motor 110, the body 111 of which is attached to support arm 100, and a wheel 120 coupled to the shaft of motor 110.

Figure 2:
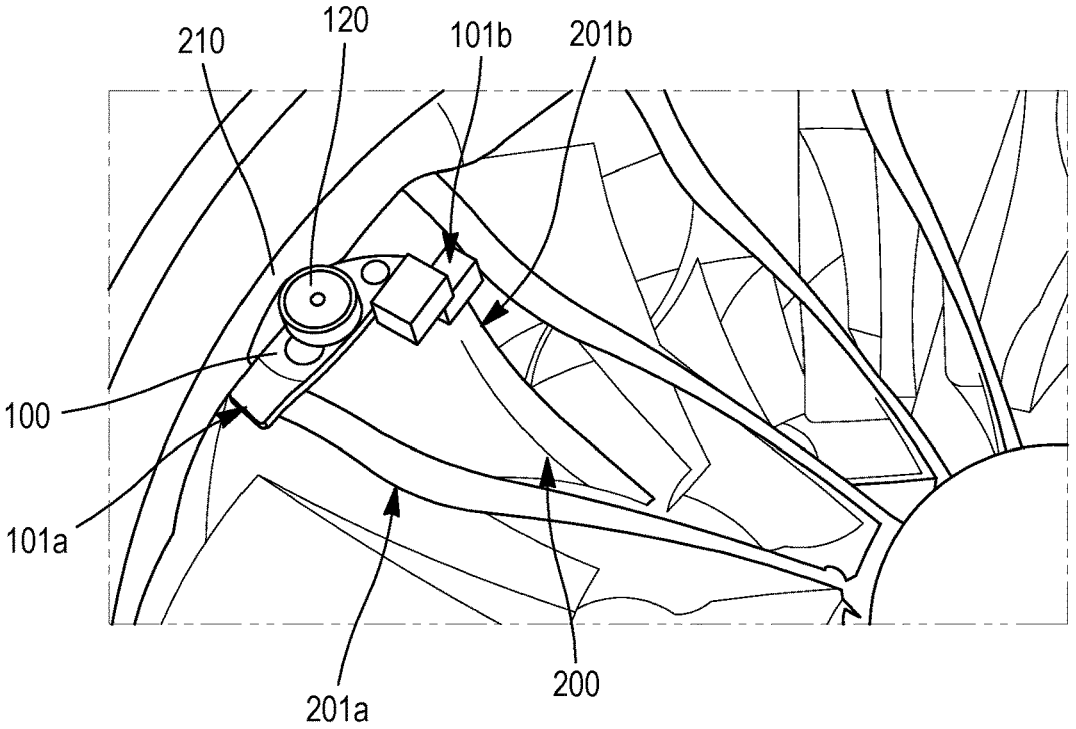
FIG. 2 represents the drive system of FIG. 1 mounted on a turbofan fan blade.

Support arm 100 is configured to be mounted on a blade 200 of the rotor which is to be rotated, as illustrated in FIG. 2. A first end 101*a* of arm 100 is arranged to be able to grip leading edge 201*a* (or upstream edge) of blade 200 and a second end 101*b* of the arm, positioned opposite first end 101*a*, is configured to grip trailing edge 201*b* (or downstream edge) of this same blade. Between its first and second ends 101*a*-101*b*, arm 100 is curved with substantially the same curve as the aerodynamic profile of blade 200.

In the example installation of FIG. 2, blade 200 belongs to the fan rotor of a turbofan. The blades of the fan rotor are surrounded by an outer casing 210, of annular shape. Outer casing 210 is a fixed portion of the fan, or in other words a portion of the fan stator. Support arm 100 is mounted at the head of blade 200, i.e. at the distal end of the blade relative to the axis of the turbojet, such that wheel 120 is able to come into contact with the inner surface of outer casing 210. The length of support arm 100 is therefore, in this example, substantially equal to the width of blade 200 at its head. The "width" of the blade in this case refers to the distance separating its leading edge 201*a* from its trailing edge 201*b*.

To install the drive system on blade 200 of the fan rotor, the operator undertaking the control positions himself upstream from the fan. Since trailing edge 201*b* of the fan is of more difficult access than its leading edge 201*a* (since it is further from the operator), second end 101*b* of the arm is preferably positioned firstly on blade 200 and has no adjustment mechanism. It is, for example, folded back on itself, with the shape of a hook, such that it can be attached to trailing edge 201*b*. Conversely, first end 101*a* of the arm can be equipped with an adjustment mechanism, to hold arm 100 tightly against blade 200. First end 101*a* comprises, for example, a clip provided with a fixed jaw 102 and a movable jaw 103, where the position of movable jaw 103 (relative to fixed jaw 102) can be adjusted by means of a screw 104.

For improved holding of support arm 100 on blade 200, an intermediate portion of the arm can be supported by a wall connecting leading and trailing edges 201*a*-201*b* of blade 200.

Wheel 120 is arranged such that its rolling strip 121 is able to come into contact with the annular wall of outer casing 210, when support arm 100 is mounted on blade 200.

The outer diameter of wheel 120 and its position on support arm 100 are consequently dictated by the geometry of the arm (which is itself dictated by that of blade 200) and the position of the arm on the blade. Rolling strip 121 of wheel 120 preferably has a high adhesion coefficient, facilitating rolling without sliding. Power losses due to sliding of tread slid 121 on the annular wall of outer casing 210 are thus significantly reduced.

A speed reducer 122 can be incorporated in wheel 120 to increase the torque delivered by motor 110. This reducer 122 comprises, for example, a gear positioned inside wheel 120, which cooperates with teeth 123 arranged on the inner periphery of wheel 120. The entry axis of reducer 122, corresponding to the motor axis, is preferably parallel to its exit axis, i.e. of the axis of wheel 120.

Motor 110 and wheel 120 are advantageously positioned between the two ends 101*a*-101*b* of support arm 100, and preferably equidistantly from these two ends. Such an arrangement prevents body 111 of the motor from coming into contact with blade 200. Furthermore, body 111 of the motor and wheel 120 are advantageously positioned either side of a parallelepipedic portion 105 of arm 100. The shaft (not represented) of motor 110 then traverses arm 100. In this configuration, the drive system of FIG. 1 is globally balanced.

Electric motor 110 is preferably a stepper motor. This type of motor allows precise and fine rotation of the motor shaft, for example in steps of 1.8° (200 steps per motor shaft revolution). The torque produced by a stepper motor is also higher than for other motors of the same power (for example direct current brush motors), particularly at low speed. Unlike these other motors, it has a holding torque enabling the turbojet's rotor to be stopped rotating (and to be held in the stopped state). Lastly, it enables the angular position of the motor axis, and therefore blade 200 relative to outer casing 210, to be known precisely.

The drive system of FIG. 1 also comprises control electronics 130, for example in the form of an electronic card (not represented), and at least one battery 140. Control electronics 130 and battery 140 are both electrically connected to motor 110. Control electronics 130 controls the operation of motor 110, while battery 140 powers motor 110 and makes the drive system autonomous in electrical terms. Control electronics 130 implements the following basic functions: switching the motor on and off, adjusting the rotational direction and adjusting the rotational speed. It can also implement other "smart" functions, such as an emergency stop with release of the holding torque, accomplishment of a complete rotor revolution (by recording of an initial set point) and control of the charge of battery 140.

In this first embodiment, control electronics 130 and battery (or batteries) 140 are secured to support arm 100. They can be contained in a single case, as represented in FIG. 1, or in separate cases. The case or cases is/are attached to support arm 100.

Control electronics 130 comprises, for example, a microcontroller, which is preferably reprogrammable, equipped with a memory in which one or more program(s) can be stored. The program executed by the microcontroller's processor can, in particular, vary depending on the type of turbojet, the inner diameter of the stator casing, the number of stages of the compressor and of the low-pressure turbine, and the number of blades in each stage of the compressor and of the turbine. The microcontroller is advantageously associated with a storage space, for example in the form of a memory card. This storage space contains data required for satisfactory execution of the program, such as the reducer's gear ratio, the number of steps per revolution of motor 110, the type of turbojet, the inner diameter of the stator casing, the number of stages of the compressor and of the low-pressure turbine, and the number of blades in each stage of the compressor and of the turbine.

Control electronics 130, and therefore operation of motor 110, can preferably be controlled from a remote control device. This remote control device enables a single operator to control rotation of the rotor and, simultaneously, to undertake an inspection of the parts of the turbojet, for example using an endoscope. It has, for example, an on/off button, a potentiometer to adjust the speed and/or direction of rotation of the motor, a button for recording the position of the rotor (set point) and an "emergency stop" button.

The remote control device is preferably wireless. It can thus be used wherever the operator is positioned relative to the turbojet. Electronics 130 and the remote control device then each comprise wireless communication means, for example of the Bluetooth type.

Figure 3:
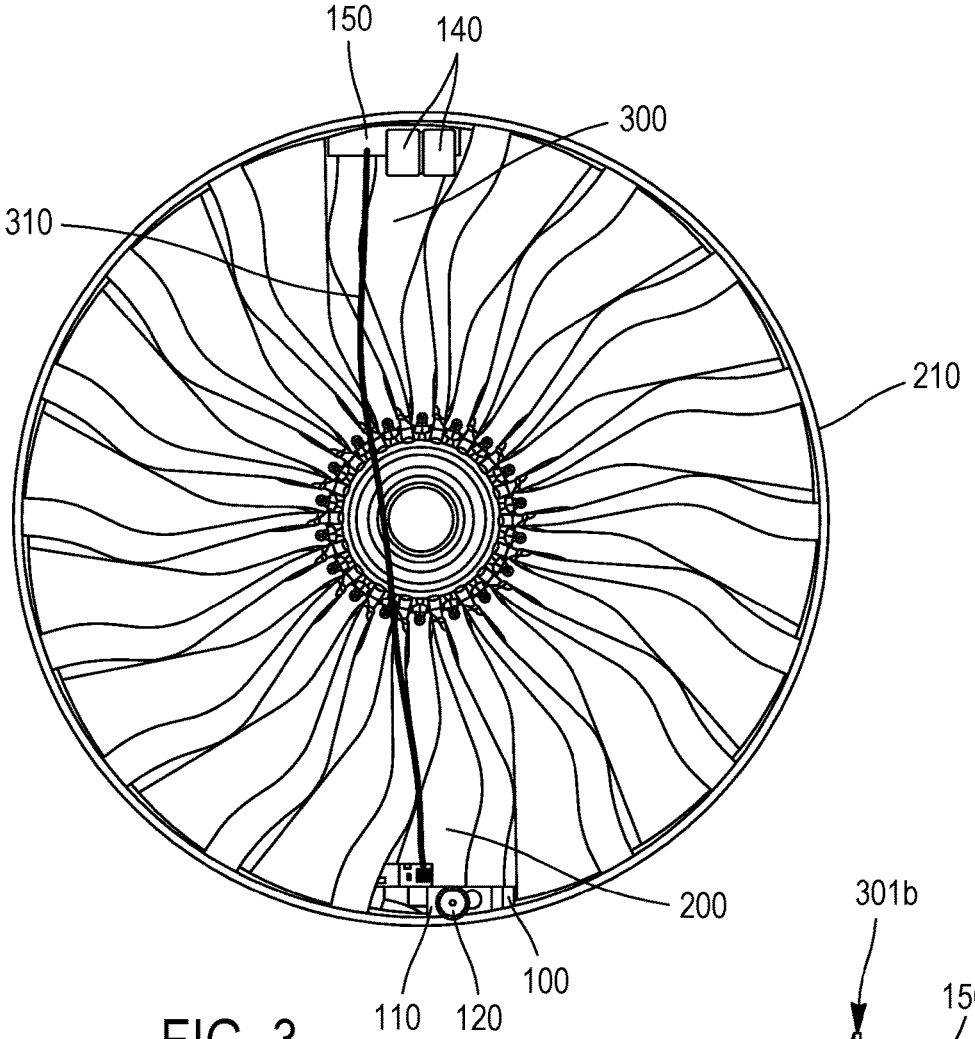
FIG. 3 represents a drive system according to a second embodiment of the invention, installed in a turbofan fan.

FIG. 3 illustrates a second embodiment of the drive system according to the invention, installed in the fan of the turbofan. This second embodiment differs from the first embodiment (FIGS. 1-2) in that batteries 140 (of which there are two in this case) are installed remotely on a second blade 300 diametrically opposite first blade 200, which supports support arm 100. Batteries 140 are mounted on second blade 300 by means a battery tray 150.

In other words, the drive system of FIG. 3 is comprised of two subassemblies of elements:

- a first subassembly mounted on first blade 200 and comprising support arm 100, motor 110 and wheel 120;
- a second subassembly mounted on second blade 300 and comprising batteries 140 and battery tray 150.

The two subassemblies, and more specifically motor 110 and batteries 140, are electrically connected, for example by means of electric wires surrounded by sheath 310.

Placing batteries 140 opposite support arm 100 enables the weight of the first subassembly (support arm 100—motor 110—wheel 120) to be counterbalanced, and enables the torque for passing certain angular positions of the rotor (typically 3 H and 9 H) to be more easily overcome. An electric motor 110 which is less powerful (which is therefore smaller and less heavy) than that of the first embodiment can then be used. The electrical power consumption of the system is consequently lower in this second embodiment (motor current equal to 0.5 A instead of 2.8 A for the first embodiment), which increases the autonomy of batteries 140.

To maximise this counterbalancing effect, the two subassemblies preferably have substantially identical masses (±10%).

Given its weight is negligible compared to the other elements of the system, control electronics 130 can belong either to the first subassembly or to the second subassembly.

Figure 4:
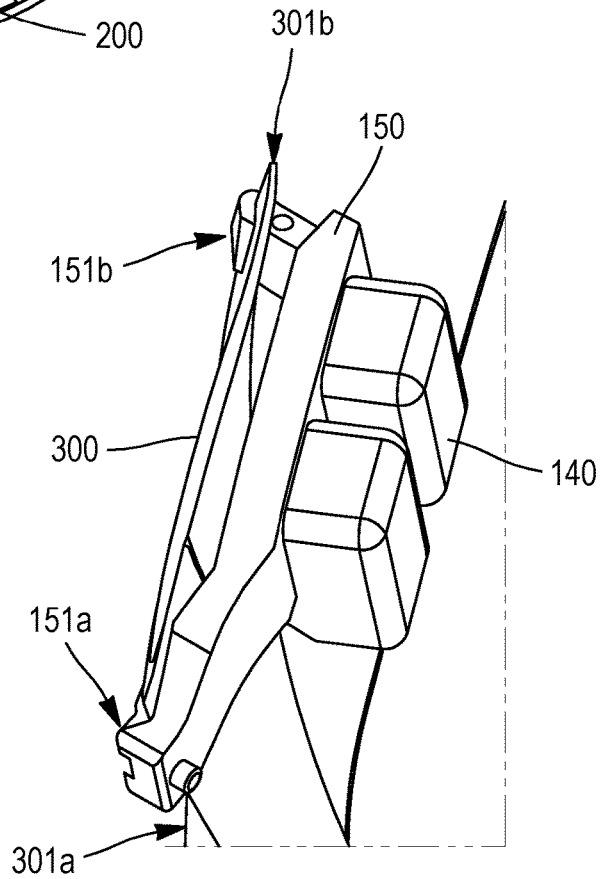
FIG. 4 represents a subassembly of the drive system of FIG. 3, comprised of batteries and their tray, in position on a second opposite blade of the fan.

FIG. 4 is a close-up view of batteries 140 and of battery tray 150 to which they are attached. Battery tray 150 is preferably manufactured in the same way as support arm 100. In other words, its shape matches the aerodynamic profile of second blade 300 and comprises two ends 151*a*-151*b* arranged for gripping leading and trailing edges 301*a*-301*b* of second blade 300. The two ends 151*a* and 151*b* can be arranged in the same way as those of support arm 100, respectively with a clip and a hook.

Support arm 100, wheel 120 and battery tray 150 are preferably made essentially of a polymer material, such as polylactic acid (PLA). Choosing such a material enables the weight of the drive system according to the invention to be reduced significantly. This system weighs approximately 3 kg (compared to 20 kg for the drive system of the prior art), including 1.5 kg for the batteries alone. Polymer materials are, furthermore, resistant under normal conditions of use, and do not risk damaging the nearby parts of the turbojet, such as the fan blades, the fan casing or the abradable material which covers the inside of the fan case.

Since it is attached to the rotor's blade ring by means of support arm 100 (and to battery tray 150, if applicable), the drive system according to the invention is particularly simple to use. Installing it on a turbomachine rotor requires no prior disassembly, if the rotor blades are accessible by the operator. For the same reasons, removing it from the rotor is equally rapid and easy. It is also light and compact, which means that it can be operated by a single person. For a fan rotor, its maximum dimension (in this case the length) is, for example, of the order of 32 cm. Wheel 120 has, for example, a diameter of 9 cm for an outer casing measuring 195 cm in diameter. Rolling strip 121 measures, for example, 3.5 cm in width.

Thanks to its compactness, its lightness and its autonomy, the drive system according to the invention can be used for maintenance operations on the runway (without removing the propulsion system). It can, of course, also be used in a workshop for pre-delivery quality controls or maintenance operations.

The invention has been described above taking as an example application a turbofan fan comprising an outer casing 210 (i.e. a casing delimiting the exterior of an aerodynamic vein). As previously mentioned, the drive system of FIGS. 1 to 4 is compatible with other types of rotor and/or other types of turbomachine. In certain applications (for example for a turbojet of the "Open Rotor" type), wheel 120 could come into contact with an inner (annular) casing (i.e. one delimiting the interior of the aerodynamic vein), rather than the exterior one. Support arm 100, and battery tray 150 if applicable, will then be mounted at the root of the blade (the proximal end relative to the axis of the turbomachine).

Lastly, many variants and modifications of the drive system according to the invention will occur to a person skilled in the art. For example, the configuration of the first and second ends of support arm 100 (and of battery tray 150) can be reversed if it is desired to gain access to the annular row of rotor blades from downstream rather than from upstream, typically for rotors other than that of the fan. In this case, second end 101*b* of the arm will preferentially be equipped with a clamping mechanism and will grip the trailing edge of the blade lastly.

The invention claimed is:

1. A drive system for rotating a turbomachine rotor relative to a stator casing, the rotor comprising an annular row of blades, the drive system comprising:

a support arm comprising a first end adapted to grip a leading edge of a first blade of the annular row and a second end adapted to grip a trailing edge of the first blade;

an electric motor comprising a shaft and a body attached to the support arm;

a wheel coupled to the shaft of the motor and provided with a rolling strip, the wheel being further arranged such that the rolling strip is able to come into contact with an annular wall of the stator casing when the support arm is mounted on the first blade, a battery tray configured to be mounted on a second blade of the annular row, diametrically opposite the first blade, and at least one battery secured to the battery tray and electrically connected to the electric motor.

2. The system according to claim 1, wherein the motor and the wheel are positioned between the first and second ends of the support arm.

3. The system according to claim 1, comprising at least one battery secured to the support arm and electrically connected to the motor.

4. The system according to claim 1, wherein the battery tray comprises a first end arranged for gripping a leading edge of the second blade and a second end arranged for gripping a trailing edge of the second blade.

5. The system according to claim 1, wherein:

the support arm, the electric motor and the wheel belong to a first subassembly of elements intended to be mounted on the first blade;

the battery tray and the at least one battery belong to a second subassembly of elements intended to be mounted on the second blade; and the first and second subassemblies of elements have substantially identical masses.

6. The system according to claim 1, wherein the first end of the support arm comprises a clamp and the second end of the support arm is shaped like a hook.

7. The system according to claim 1, wherein the electric motor is a stepper motor.

8. The system according to claim 1, wherein the wheel is equipped with a speed reducer.

9. The system according to claim 1, wherein the support arm is made of a polymer material.

10. A turbomachine rotor equipped with the system according to claim 1.

11. The system according to claim 9, wherein the polymer material is polylactic acid (PLA).

12. The turbomachine rotor according to claim 10, wherein the rotor is a turbofan rotor.

13. The system according to claim 1, wherein a length of the support arm is equal to or greater than a width of the first blade.

14. A drive system for rotating a turbomachine rotor relative to a stator casing, the rotor comprising an annular row of blades, the drive system comprising:

a support arm comprising a first end adapted to grip a leading edge of a first blade of the annular row and a second end adapted to grip a trailing edge of the first blade;

an electric motor comprising a shaft and a body attached to the support arm, and a wheel coupled to the shaft of the motor and provided with a rolling strip, the wheel being further arranged such that the rolling strip is able to come into contact with an annular wall of the stator casing when the support arm is mounted on the first blade, wherein the support arm is curved to follow a contour of an aerodynamic profile of the first blade.

15. The system according to claim 1, wherein the first end has a first receiving surface to grip the leading edge of the first blade and extend over at least part of each opposite main face of the first blade when the leading edge of the first blade is gripped by the first end and the second end has a second receiving surface to grip the trailing edge of the first blade and extend over at least part of each said opposite main face of the first blade when the trailing edge of the first blade is gripped by the second end.

* * * * *